US010707009B2

(12) United States Patent
Ryu et al.

(10) Patent No.: US 10,707,009 B2
(45) Date of Patent: Jul. 7, 2020

(54) THIN FILM-TYPE INDUCTOR

(71) Applicant: SAMSUNG ELECTRO-MECHANICS CO., LTD., Suwon-si, Gyeonggi-do (KR)

(72) Inventors: Joung Gul Ryu, Suwon-si (KR); Byeong Cheol Moon, Suwon-si (KR); Jin Hyuk Jang, Suwon-si (KR)

(73) Assignee: SAMSUNG ELECTRO-MECHANICS CO., LTD., Suwon-si, Gyeonggi-do (KP)

( * ) Notice: Subject to any disclaimer, the term of this patent is extended or adjusted under 35 U.S.C. 154(b) by 173 days.

(21) Appl. No.: 15/818,468

(22) Filed: Nov. 20, 2017

(65) Prior Publication Data

US 2018/0374627 A1 Dec. 27, 2018

(30) Foreign Application Priority Data

Jun. 23, 2017 (KR) ..... 10-2017-0079809

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 17/04; H01F 17/0013; H01F 2017/048; H01F 2017/002;
(Continued)

(56) References Cited

U.S. PATENT DOCUMENTS 5,515,022 A * 5/1996 Tashiro ..... H01F 17/0013 174/262
7,859,080 B2 * 12/2010 Kuwajima ..... H01G 4/33 257/275
(Continued)

FOREIGN PATENT DOCUMENTS

JP 2001-267166 A 9/2001
JP 2003-46249 A 2/2003
(Continued)

OTHER PUBLICATIONS

Office Action issued in corresponding Japanese Patent Application No. 2017-223936, dated Aug. 7, 2018.
(Continued)

*Primary Examiner* — Mang Tin Bik Lian
(74) *Attorney, Agent, or Firm* — Morgan, Lewis & Bockius LLP

(57) ABSTRACT

A thin film-type inductor includes a body including a support member having a through-hole filled with a magnetic material and a via hole, a coil disposed on at least one side of the support member and including a plurality of coil patterns, and a magnetic material sealing the support member and the coil. Each of the coil patterns includes a first conductor layer, a second conductor layer, and a third conductor layer. The second conductor layer is disposed on a side surface of the via hole, and is disposed to seal a lower surface of the via hole.

17 Claims, 5 Drawing Sheets

(51) Int. Cl.

| | |
|---|---|
| ***H01F 27/255*** | (2006.01) |
| ***H01F 27/29*** | (2006.01) |
| ***H01F 17/00*** | (2006.01) |
| ***H01F 17/04*** | (2006.01) |
| *H01F 27/32* | (2006.01) |

(52) U.S. Cl.
CPC ..... *H01F 27/255* (2013.01); *H01F 27/292* (2013.01); *H01F 27/324* (2013.01); *H01F 2017/002* (2013.01); *H01F 2017/048* (2013.01); *H01F 2027/2809* (2013.01)

(58) Field of Classification Search
CPC ..... H01F 2017/0073; H01F 27/2804; H01F 27/255; H01F 27/292; H01F 27/323; H01F 27/324; H01F 2027/2809
USPC ..... 336/200, 223, 233, 192
See application file for complete search history.

(56) References Cited

U.S. PATENT DOCUMENTS

| | | | | |
|---|---|---|---|---|
| 8,009,006 | B2 * | 8/2011 | Ahn | H01F 17/0013 336/200 |
| 2010/0148905 | A1 * | 6/2010 | Matsumoto | H01F 17/0013 336/137 |
| 2013/0062106 | A1 * | 3/2013 | Kim | H05K 3/4658 174/257 |
| 2013/0222101 | A1 * | 8/2013 | Ito | H01F 17/04 336/83 |
| 2013/0300529 | A1 | 11/2013 | Chang et al. | |
| 2014/0091892 | A1 * | 4/2014 | Tominaga | H05K 1/165 336/200 |
| 2015/0035634 | A1 * | 2/2015 | Nakamura | H01F 17/0013 336/170 |
| 2015/0048918 | A1 * | 2/2015 | Park | H01F 17/0013 336/200 |
| 2015/0109088 | A1 | 4/2015 | Kim et al. | |
| 2016/0086721 | A1 | 3/2016 | Park et al. | |
| 2016/0336105 | A1 | 11/2016 | Choi et al. | |
| 2017/0032882 | A1 | 2/2017 | Yang et al. | |
| 2017/0148562 | A1 | 5/2017 | Lee et al. | |

FOREIGN PATENT DOCUMENTS

| | | | | |
|---|---|---|---|---|
| JP | 2009152347 | A | * | 7/2009 |
| JP | 2015-32625 | A | | 2/2015 |
| JP | 2015-119158 | A | | 6/2015 |
| JP | 2015-187260 | A | | 10/2015 |
| JP | 2016-213443 | A | | 12/2016 |
| JP | 2017-98544 | A | | 6/2017 |
| KR | 10-1999-0066108 | A | | 3/1999 |
| KR | 10-2001-0060271 | A | | 7/2001 |
| KR | 10-2015-0019588 | A | | 2/2015 |
| KR | 10-2015-0046717 | A | | 4/2015 |
| KR | 10-2016-0035819 | A | | 4/2016 |
| KR | 10-2017-0014957 | A | | 2/2017 |

OTHER PUBLICATIONS

Office Action issued in Corresponding Korean Patent Application No. 10-2017-0079809, dated Jul. 6, 2018.

* cited by examiner

THIN FILM-TYPE INDUCTOR

CROSS-REFERENCE TO RELATED APPLICATION

This application claims the benefit of priority to Korean Patent Application No. 10-2017-0079809, filed on Jun. 23, 2017 in the Korean Intellectual Property Office, the disclosure of which is incorporated herein by reference in its entirety.

TECHNICAL FIELD

The present disclosure relates to a thin film-type inductor, and particularly, to a thin film-type power inductor having an ultra-thin support member.

BACKGROUND

Along with the development of IT technology, the miniaturization and thinning of devices are accelerating, and at the same time, market demand for small, thin devices has increased.

To adapt to the demands of such a technological trend, a power inductor including a substrate having a via hole and a coil disposed on both sides of the substrate and electrically connected through a via hole of the substrate is provided. Thus, an inductor including a coil having uniformity and a high aspect ratio has been attempted. However, due to limitations in the manufacturing process, there remain issues in forming a coil having uniformity and a high aspect ratio.

SUMMARY

An aspect of the present disclosure provides a thin film power inductor having high capacity, having been thinned by increasing a total thickness of a coil while maintaining a total thickness of a CCL core, according to the related art.

According to an aspect of the present disclosure, a thin film-type inductor includes a body including a support member having a through-hole filled with a magnetic material and a via hole, a coil disposed on at least one side of the support member and including a plurality of coil patterns, and a magnetic material sealing the support member and the coil. The thin film-type inductor further includes an external electrode disposed on an external surface of the body and connected to the coil. Each of coil patterns includes a first conductor layer, a second conductor layer, and a third conductor layer. The first conductor layer is a base conductor layer of the second conductor layer and the third conductor layer. The second conductor layer is disposed on a side surface of the via hole formed in the support member and is disposed to seal a lower surface of the via hole.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
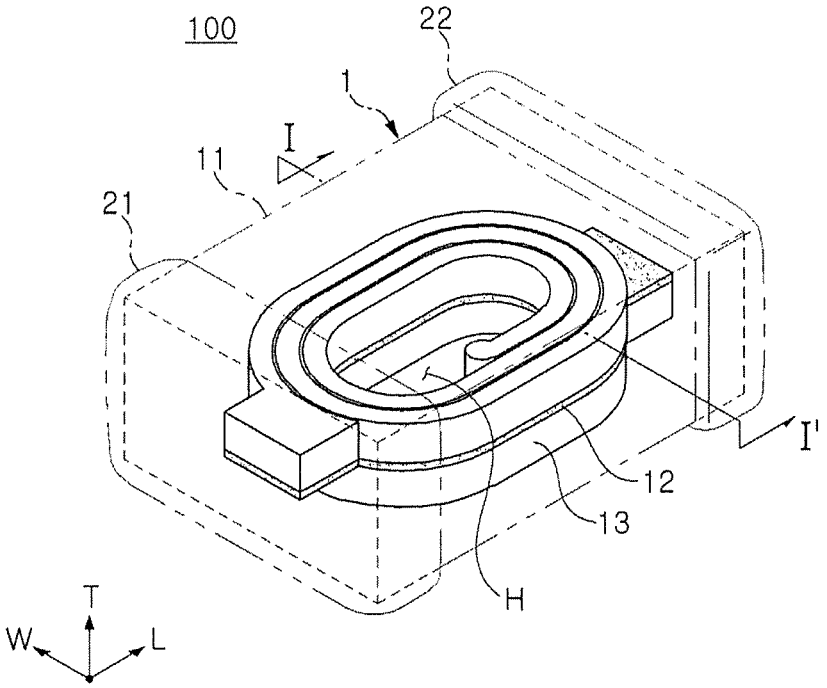
FIG. 1 is a schematic perspective view of a thin film-type inductor according to an embodiment.

Hereinafter, embodiments of the present disclosure will be described as follows with reference to the accompanying drawings. In the accompanying drawings, shapes, sizes and the like, of the components may be exaggerated or shortened for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being 'on,' 'connected to,' or 'coupled to' another element, it can be directly 'on,' 'connected to,' or 'coupled to' the other element or other elements intervening therebetween may be present. In contrast, when an element is referred to as being 'directly on,' 'directly connected to,' or 'directly coupled to' another element, there may be no other elements or layers intervening therebetween. Like numerals refer to like elements throughout. As used herein, the term 'and/or' includes any and all combinations of one or more of the associated listed items.

It will be apparent that although the terms first, second, third, etc. may be used herein to describe various members, components, regions, layers and/or sections, any such members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as 'above,' 'upper,' 'below,' and 'lower' and the like, may be used herein for ease of description to describe one element's relationship relative to another element(s) as shown in the figures. It will be understood that spatially relative terms are intended to encompass different orientations of the device in use or operation, in addition to the orientation depicted in the figures. For example, if the device in the figures is turned over, elements described as 'above,' or 'upper' relative to other elements would then be oriented 'below,' or 'lower' relative to the other elements or features. Thus, the term 'above' can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms 'a,' 'an,' and 'the' are intended to include the plural forms as well, unless the context clearly indicates otherwise. It will be further understood that the terms 'comprises,' and/or 'comprising' when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted alone, in combination or in partial combination.

The contents of the present disclosure described below may have a variety of configurations and propose only a required configuration herein, but are not limited thereto.

Hereinafter, a thin film-type inductor according to an embodiment is illustrated, but embodiments are not limited thereto.

Thin Film-Type Inductor

FIG. 1 is a schematic perspective view of a thin film-type inductor according to an embodiment. Referring to FIG. 1, a thin film-type inductor 100 includes a body 1 forming an outer cover as well as a first external electrode 21 and a second external electrode 22 disposed on an external surface of the body.

The body 1 includes an upper surface and a lower surface opposing each other in a thickness (T) direction, a first side surface and a second side surface opposing each other in a length (L) direction, and a first end surface and a second end surface opposing each other in a width (W) direction. The various surfaces of the body provide the body a substantially hexahedral shape, but embodiments are not limited thereto.

The body 1 further includes a magnetic material 11. The magnetic material in the body may be provided by mixing a resin with a ferrite or metal magnetic particle. In an embodiment, the metal magnetic particle includes one or more selected from the group consisting of iron (Fe), silicon (Si), chrome (Cr), aluminum (Al), nickel (Ni), and any combination thereof.

In addition to the magnetic material 11, the body 1 includes a support member 12 and a coil 13, sealed by the magnetic material.

The first external electrode 21 and the second external electrode 22 are disposed on an external surface of the body 1 to oppose each other in a length direction. The first external electrode 21 and the second external electrode 22 may have a C-shape as illustrated in FIG. 1, or may have an L-shape, so as to not extend on an upper surface of the body. Alternatively, the first external electrode and the second external electrode may each be a bottom electrode, only disposed on a lower surface of the body. The first external electrode 21 and the second external electrode 22 need not have the same shape. For example, in an embodiment, the first external electrode 21 is C-shaped and the second external electrode 22 is L-shaped.

The first external electrode 21 and the second external electrode 22 are electrically connected to the coil 13 in the body 1, and are thus formed of a material having excellent electrical conductivity. For example, the material may be Ni, Al, copper (Cu), silver (Ag) or alloys thereof, and may be provided as a plurality of layers. In some cases, after a Cu line plating layer is formed in an innermost portion, an additional plating layer may be disposed. As described above, a person skilled in the art may appropriately select a material and a forming method.

Figure 2:
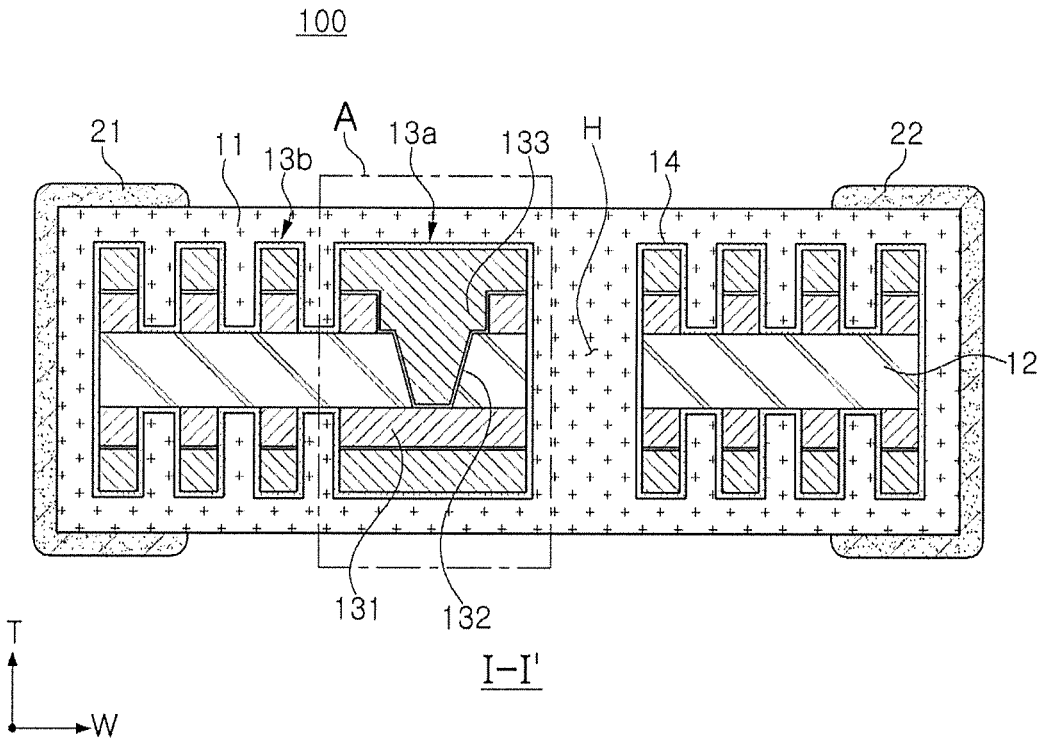
FIG. 2 is a schematic cross-sectional view taken along line I-I' of the thin film-type inductor of FIG. 1.
Figure 3:
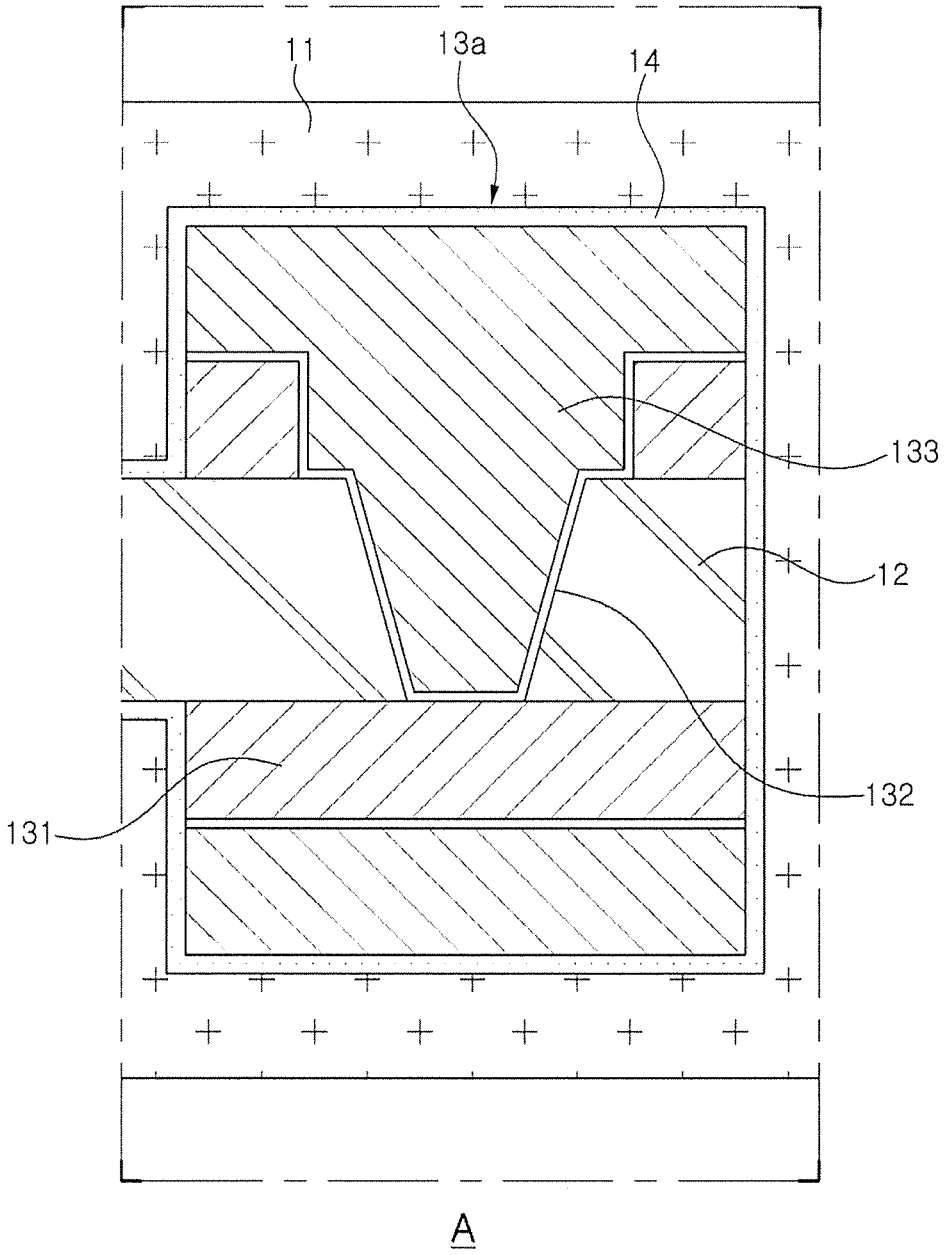
FIG. 3 is an enlarged view in which region A of FIG. 2 is enlarged.

FIG. 2 is a cross-sectional view taken along line I-I' of FIG. 1, and FIG. 3 is an enlarged view in which region A of FIG. 2 is enlarged.

Referring to FIGS. 2 and 3, the support member 12 is formed in a thin plate shape supporting the coil 13. The support member 12 is provided to further form the coil 13 in a thinner shape. The support member 12 may be an insulating substrate formed of an insulating resin. In an embodiment, the support member is a copper clad laminate (CCL) core disposed between copper foil layers of CCL. When CCL is used as it is, thickness of the coil is significantly increased without the aid of a support carrier, or the like. Moreover, a thermosetting resin such as epoxy resin, a thermoplastic resin such as polyimide, or a resin in which a reinforcement material such as a glass fiber or an inorganic filler is impregnated, for example, prepreg, an ajinomoto build-up film (ABF), FR-4, bismaleimide triazine (BT) resin, photo imageable dielectric (PID) resin, or the like may be used. When the glass fiber is included in the support member, rigidity may be improved.

A thickness of the support member 12 may be about 25 μm to 40 μm, which is significantly less than a thickness of an insulating portion of a CCL support member used in a conventional thin film-type inductor, which is about 60 μm. When a chip size of a thin film-type inductor is reduced, for example, to a 1005 size, reducing the thickness of the support member to about 30% has a technically significant advantage. As a size of an inductor is reduced, miniaturization of a chip without loss of chip characteristics of an inductor such as inductance, DC resistance (Rdc), or the like, may be achieved by reducing a length of a magnetic passage of a coil and increasing an area of a magnetic passage. In addition fine patterning for increasing the number of turns of a coil pattern, the use of a high permeability material, and the like, may further improve characteristics of the inductor. When a thickness of a support member is reduced, effects of a reduction in a length of a magnetic passage and an increase in an area of a magnetic passage may be simultaneously secured.

In an embodiment, a through-hole H is formed in the center of the support member 12. As an interior of the through-hole is filled with a magnetic material, permeability of an inductor may be significantly improved.

The coil 13 is disposed in an upper surface and a lower surface of the support member 12. While the coil 13 is illustrated as having a spiral shape in the figures, embodiments are not limited thereto and a shape of the coil may be suitably modified by those skilled in the art as needed.

The coil 13 includes a plurality of coil patterns 13*a*, 13*b*, . . . . In an embodiment, each coil pattern includes a plurality of conductor layers, such as at least a first conductor layer 131, a second conductor layer 132, and a third conductor layer 133.

Referring to FIGS. 2 and 3, the first conductor layer 131 is a base conductor layer which is a base of the second conductor layer 132 and the third conductor layer 133. In an embodiment, thickness of the first conductor layer 131 is about 9 μm to 18 μm. The thickness of the first conductor layer may not be reduced below, for example, 9 μm, as a thickness of a support member is reduced to about 25 μm to 40 μm, while an overall thickness and a basic structure of CCL are maintained.

Referring to FIGS. 2 and 3, the first conductor layer 131 is disposed to be in contact with the second conductor layer 132 sealing a lower surface of a via hole in the support member 12, in a lower portion of the via hole. The first conductor layer 131 is disposed to be contact with the support member 12 at an upper surface or a lower surface of the support member 12 except for the lower portion of the via hole. Thus, the first conductor layer 131 may substantially function as a seed pattern of the second conductor layer 132 and the third conductor layer 133.

The first conductor layer 131 may be a copper foil layer formed using rolling or electrolytic plating on the support member 12, but embodiments are not limited thereto. Moreover, surface roughness, electrical characteristics, or the like, of the first conductor layer 131 may be appropriately designed and modified by those skilled in the art, and may be appropriately selected in consideration of required characteristics and manufacturing conditions.

Next, the second conductor layer 132, as a thin film layer having a thickness thinner than that of the first conductor layer 131 and the third conductor layer 132, such as about 1 μm or less. In an embodiment, the second conductor layer 132 is deposited using, for example, RF sputtering. A material of the second conductor layer 132 may be used without limitation as long as a material can be processed using a metal sputtering process. For example, the material of the second conductor layer is one or more of molybdenum (Mo), Al, titanium (Ti), Ni, and W, in an embodiment.

As the second conductor layer 132 is formed of a thin film layer using a metal sputtering process, an error of an average thickness occurs to be 500 nm or less according to a location of the second conductor layer 132, so a substantially uniform conductor layer may be provided.

The second conductor layer 132 is disposed to be in contact with a side surface of a via hole. As described later, an interior of the via hole is filled with the third conductor layer 133, the second conductor layer 132 in contact with the side surface of the via hole may function as a base of the third conductor layer 133 filling an interior of the via hole.

In addition, the second conductor layer 132 is disposed to have a structure sealing a lower surface of the via hole of the support member 12, with the side surface of the via hole.

The third conductor layer 133, disposed above the second conductor layer 132, is a conductor layer substantially determining an aspect ratio of a coil. A width of the third conductor layer 133 is substantially the same as a width of an upper surface of the second conductor layer 132 disposed on a lower surface thereof, which is a result of using patterning of an insulating pattern to be removed, after the second conductor layer 132 is formed. Thus, when a coil having a high aspect ratio is formed, issues such as non-uniform plating, occurrence of short-circuits between adjacent coils, or the like, occurring in the related art do not occur.

To allow the first conductor layer 131, the second conductor layer 132, and the third conductor layer 133 to be insulated from the magnetic material of the body 1, an insulating film 14 is additionally disposed. In an embodiment, the insulating film 14 is formed of a material which is uniform and thin while having excellent workability and insulating properties. For example, a resin containing phenylene is processed using chemical vapor deposition (CVD) to form an insulating film in an embodiment.

Figure 4:
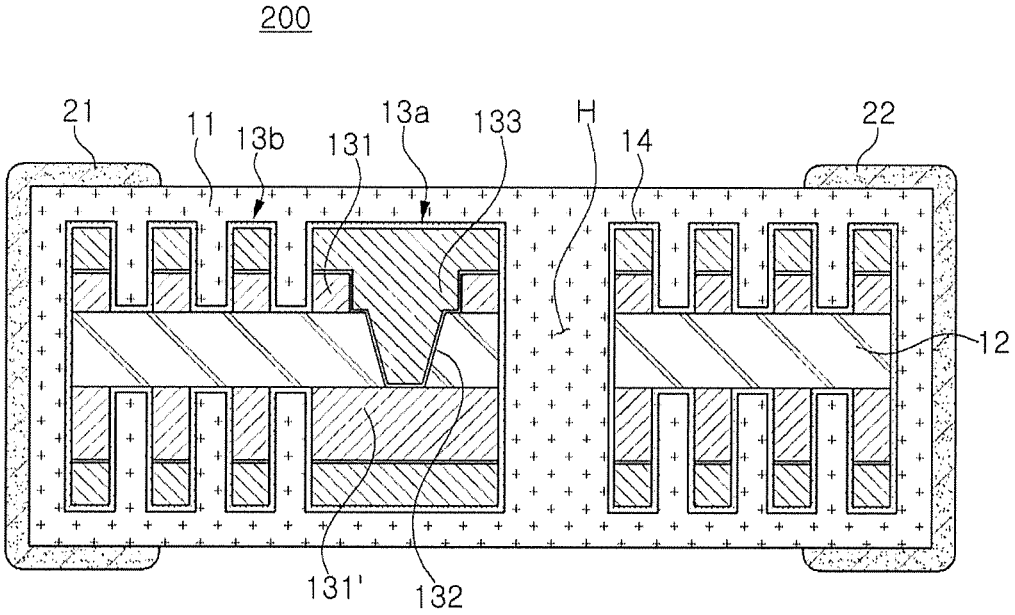
FIG. 4 is a schematic cross-sectional view of a modification of FIG. 2.

FIG. 4 is a schematic cross-sectional view of a coil component 200 according to a modification of the coil component of FIG. 2. For convenience of description, a description overlapping with that of FIG. 2 is omitted, and the same reference numerals are used for substantially the same components.

The coil component 200 of FIG. 4 has a difference in that a first conductor layer 131' disposed on a lower surface of the support member 12 is thicker, compared to that of the embodiment depicted in FIG. 2. In this case, the first conductor layer 131 disposed on an upper surface of the support member 12 and the first conductor layer 131' disposed on a lower surface are asymmetric in terms of thickness. In terms of location and function, the first conductor layer 131, which is relatively thin, is referred to as an upper seed pattern, and the first conductor layer 131', which is relatively thick, is referred to as a lower seed pattern. As an example, while a thickness of the first conductor layer 131' is about 12 μm to 18 μm, a thickness of the first conductor layer 131 is about 2 μm to 5 μm in an embodiment. In the coil component 200 of FIG. 4, a thin film layer, which is thicker, is formed on a lower surface of a support member, compared to in an upper surface of the support member. Thus, during a machining process of forming the via hole in the support member 12, $CO_2$ laser processing may be allowed to be easily performed on an upper surface of the support member, while the first conductor layer 131' may function to stably form a pad on a lower surface of the support member 12. Here, the pad indicates a first layer, of the first conductor layer 131', having a width greater than a width of a lower surface of a via hole, as a conductor layer supporting the second conductor layer 132 sealing the lower surface of the via hole. When the first conductor layer 131' serving as a pad is formed, a case in which a nodule is relatively great or a copper foil layer provided using a rolling method is included therein, may prevent an open failure from occurring when a via is processed.

Due to the coil component according to an embodiment, as an overall thickness of conventional CCL may be applied as it is, while existing facilities are used without additional facility investment, a thickness of a support member can be significantly reduced. Moreover, the thickness thereof may be varied according to a selection of a person skilled in the art. In addition, since a thickness of a support member is significantly reduced in an inductor having the same area and the same size as those according to the related art, it is advantageous to reduce a length of a magnetic passage in a thickness direction and to increase an inductance value and a DC-bias value according to a cover thickness. In addition, as a support member is significantly reduced, a degree of freedom to adjust the number of turns and an aspect ratio of a coil according to the specifications also increases. Unlike in a method of detaching a core, embodiments disclosed herein do not require the use of a detached copper foil (DCF). Thus, costs may be reduced and reliability (substrate breakage prevention, solving of a problem such as breakage, or the like.) may be improved.

With reference to FIGS. 5A-5K, coil component 100 of FIGS. 1 to 3 in various stages of a method of manufacturing the coil component according to an embodiment is explained. The method of manufacturing may be modified by appropriately changing a design by a person skilled in the art.

Figure 5A:
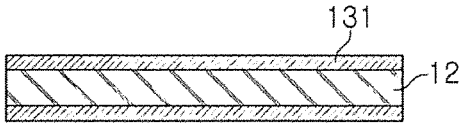
FIGS. 5A-5K schematically illustrate a thin film-type inductor at various steps during manufacturing of the thin film-type inductor according to an embodiment.

Referring to FIG. 5A, a support member 12 and a first conductor layer 131 are prepared to have a total thickness amenable for use in a conventional facility. A method of forming a first conductor layer disposed on the support member is not particularly limited. For example, a copper foil rolling method is used in an embodiment.

Figure 5B:
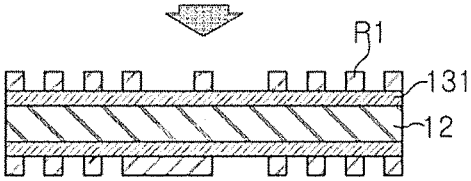
Figure 5C:
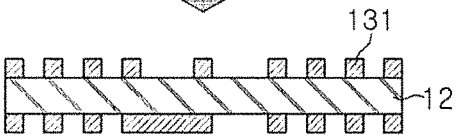

Next, referring to FIGS. 5B and 5C, after a first insulating pattern R1 for patterning the first conductor layer is disposed, the first conductor layer 131 is processed to have a spiral shape as a whole, through exposure and development processes performed on the first insulating pattern.

Figure 5D:
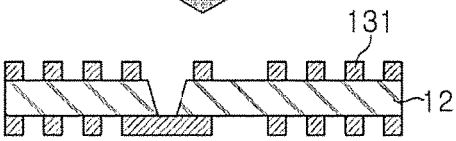

FIG. 5D illustrates a via hole formed in the support member using a suitable process. Through a process described above, a via hole, and a pad of the first conductor layer 131 in a lower portion of the via hole are provided.

Figure 5E:
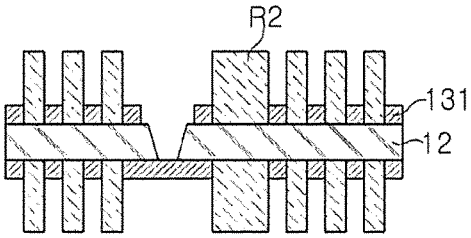

FIG. 5E illustrates a plurality of insulating sheets laminated on the support member 12. The insulating sheets are patterned to form a second insulating pattern R2 interposed between adjacent patterns of the first conductor layer 131. Here, according to a material of an insulating sheet, only an insulating sheet having a relatively great thickness while being a single may be applied. Meanwhile, a material of an insulating sheet may be an epoxy-based material, or may be an acrylate-based material. In addition, the material may include all films or sheets to which an exposure process can be applied.

A width of the second insulating pattern R2 is substantially the same as a width of the first insulating pattern R1, and a thickness thereof may be appropriately selected. However, in order to obtain a coil with a high aspect ratio, it is preferable to have a significant thickness compared to a width. Alternatively, a width of the second insulating pattern R2 may be differentiated from a width of the first insulating pattern R1, and the width of the second insulating pattern R1 may be modified to be small at a ratio of 1:0.5 or more.

Figure 5F:
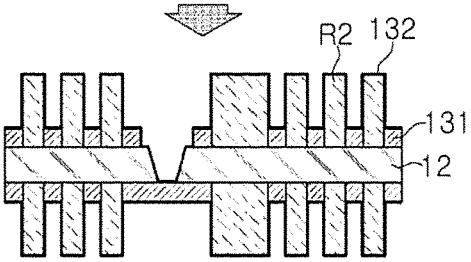

FIG. 5F illustrates a metal sputtered to form the second conductor layer 132. As a metal thin film layer, which is relatively thin, is formed on an exposed surface, a thin film is formed on a side surface of a via hole, an upper surface of the first conductor layer 131 forming a pad as a lower surface of the via hole, and the like.

Figure 5G:
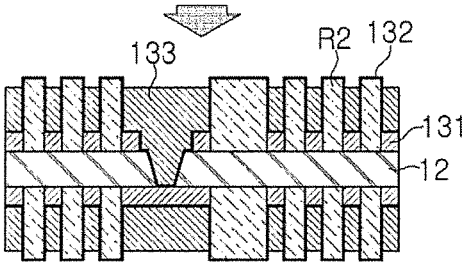

FIG. 5G illustrates openings between second insulating patterns R2 prepared through FIG. 5E filled with the third conductor layer 133. The third conductor layer 133 may be provided through a plating process, and a person skilled in the art may select an appropriate method for forming the third conductor layer 133. A height of the third conductor layer 133 may be selected depending on the specification of the inductor being manufactured. The height may be set to be lower than a height of the second insulating pattern R2 adjacent thereto, which may prevent occurrence of short-circuits between conductor layers.

Figure 5H:
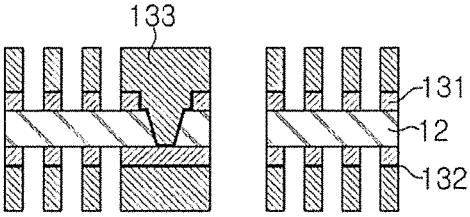

FIG. 5H illustrates the through-hole H formed for improving permeability of a magnetic core by filling the center of a support member with a magnetic material. It should be noted that the second insulating pattern R2 serving as a guide for filling the third conductor layer 133 is removed, as illustrated in FIG. 5H, once the third conductor layer 133 is formed. As a result, the coil has a structure in which the first conductor layer 131 having a spiral shape, the second conductor layer 132, and the third conductor layer 133 are stacked on a support member.

Figure 5I:
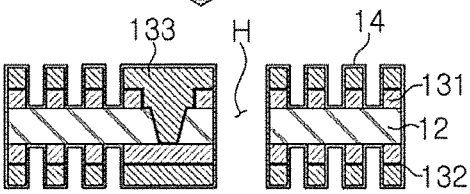

In FIG. 5I, the insulating film 14 for insulation between the first conductor layer 131, the second conductor layer 132, and the third conductor layer 133, as well as a magnetic material sealing the same is illustrated. A specific coating process is not particularly limited, but it is preferable to perform a chemical vapor deposition process for the formation of an insulating film, which is uniform and thin.

Figure 5J:
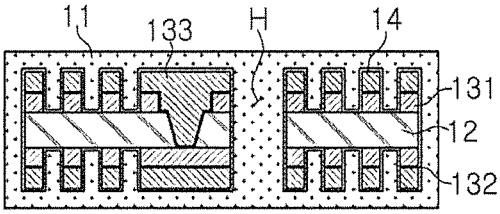

FIG. 5J illustrates the magnetic material 11 sealing the support member 12, the coil 13, and the through-hole in the center formed in FIG. 5H.

Figure 5K:
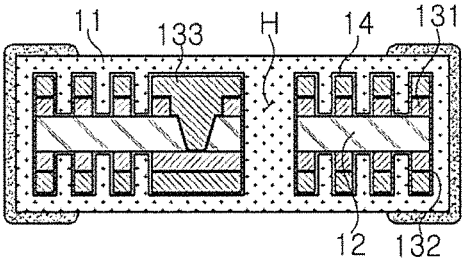

Finally, FIG. 5K illustrates the first external electrode 21 and the second external electrode 22 disposed on an external surface of the body 1. Although not specifically illustrated, a dicing process or a cutting process for exposing a lead-out portion of a coil may be added before or after disposing the first and second external electrodes.

Except for the above description, the description overlapping characteristics of the thin film-type inductor according to the exemplary embodiment described above will be omitted here.

As set forth above, according to an exemplary embodiment, a thin film-type inductor capable of increasing inductance and DC-Bias due to a reduction in a magnetic passage length and an increase in a magnetic passage area, while significantly securing an aspect ratio (AR) of a coil compared to a size of the same chip, as a thickness of a support member is significantly reduced.

While embodiments have been shown and described above, it will be apparent to those skilled in the art that modifications and variations could be made without departing from the scope of the present invention as defined by the appended claims.

What is claimed is:

1. A thin film-type inductor, comprising a body comprising a support member having a through-hole filled with a magnetic material and a via hole;

a coil disposed on at least one side of the support member and including a plurality of coil patterns, each of the coil patterns comprising a first conductor layer, a second conductor layer, and a third conductor layer; and a magnetic material sealing the support member and the coil, and an external electrode disposed on an external surface of the body and connected to the coil, wherein the first conductor layer is a base conductor layer of the second conductor layer and the third conductor layer, and is provided to have an overall spiral shape, and the second conductor layer is disposed on a side surface of the via hole, and is disposed to seal a lower surface of the via hole, wherein the second conductor layer comprises a first portion disposed between the first conductor layer and the third conductor layer, a second portion disposed between the upper surface of the support member and the third conductor layer, and a third portion in contact with the support member and disposed to cover the lower surface of the via hole, and a first connection portion in contact with side surfaces of the first conductor layer and connecting the first portion and the second portion, a second connection portion in contact with inner surfaces of the support member and connecting the second portion and the third portion, and the first connection portion is disposed on side surfaces of the via hole.

2. The thin film-type inductor of claim 1, wherein an interior of the via hole is filled with the third conductor layer.

3. The thin film-type inductor of claim 1, wherein a lower portion of the second conductor layer sealing the lower surface of the via hole is in contact with the first conductor layer.

4. The thin film-type inductor of claim 1, wherein the second conductor layer comprises one or more of molybdenum (Mo), aluminum (Al), titanium (Ti), nickel (Ni), and tungsten (W).

5. The thin film-type inductor of claim 1, wherein an average thickness of the second conductor layer disposed in a position higher than an upper surface of the support member, or a position lower than a lower surface is different from an average thickness of the second conductor layer disposed on the side surface of the via hole by 500 nm or less.

6. The thin film-type inductor of claim 1, wherein an average thickness of the second conductor layer is 1 μm or less.

7. The thin film-type inductor of claim 1, wherein the first conductor layer is a copper plating layer.

8. The thin film-type inductor of claim 1, wherein a gap among the first conductor layer, the second conductor layer, and the third conductor layer is provided with an interface among respective conductor layers.

9. The thin film-type inductor of claim 1, wherein the first conductor layer is formed of an upper seed pattern disposed on an upper surface of the support member and a lower seed pattern disposed on a lower surface of the support member, and a thickness of the upper seed pattern is thinner than a thickness of the lower seed pattern.

10. The thin film-type inductor of claim 9, wherein the thickness of the upper seed pattern is 2 μm to 5 μm, and the thickness of the lower seed pattern is 12 μm to 18 μm.

11. The thin film-type inductor of claim 1, wherein a width of an upper surface of the second conductor layer is the same as a width of a lower surface of the third conductor layer disposed above the second conductor layer.

12. The thin film-type inductor of claim 1, wherein, except in a region of the support member having the via hole, widths of the first conductor layer disposed above the support member, the second conductor layer disposed above the first conductor layer, and the third conductor layer disposed above the second conductor layer are the same.

13. The thin film-type inductor of claim 1, wherein a cross section of the via hole has a tapered shape in which a width is narrowed toward a lower surface of the support member.

14. The thin film-type inductor of claim 1, wherein the coil is electrically insulated the coil from the magnetic material using an insulating film disposed on a surface of the coil adjacent the magnetic material.

15. The thin film-type inductor of claim 14, wherein the insulating film is a phenylene-coated layer.

16. The thin film-type inductor of claim 1, wherein a first layer disposed below the via hole, of the first conductor layer, is a pad, and a width of the pad is wider than a width of the lower surface of the via hole.

17. The thin film-type inductor of claim 1, wherein a diameter of the via hole at an upper surface of the support member is greater than a diameter of the via hole at the lower surface of the support member.

* * * * *